US010839634B2

(12) United States Patent
Lawandy

(10) Patent No.: US 10,839,634 B2
(45) Date of Patent: Nov. 17, 2020

(54) TAGGANT SYSTEM

(71) Applicant: Spectra Systems Corporation, Providence, RI (US)

(72) Inventor: Nabil Lawandy, Saunderstown, RI (US)

(73) Assignee: Spectra Systems Corporation, Providence, RI (US)

( * ) Notice: Subject to any disclaimer, the term of this patent is extended or adjusted under 35 U.S.C. 154(b) by 122 days.

(21) Appl. No.: 16/214,293

(22) Filed: Dec. 10, 2018

(65) Prior Publication Data

US 2019/0180547 A1 Jun. 13, 2019

Related U.S. Application Data

(60) Provisional application No. 62/596,558, filed on Dec. 8, 2017.

(51) Int. Cl.

| | |
|---|---|
| ***G07D 7/202*** | (2016.01) |
| ***G07D 7/1205*** | (2016.01) |
| ***G07D 7/005*** | (2016.01) |

(52) U.S. Cl.

CPC ..... *G07D 7/202* (2017.05); *G07D 7/0053* (2013.01); *G07D 7/1205* (2017.05); *G07D 7/205* (2013.01)

(58) Field of Classification Search

CPC .... G07D 7/005; G07D 7/0053; G07D 7/1205; G07D 7/20; G07D 7/202; G07D 7/205; G01N 21/17; G01N 2021/1734; G01N 2021/1736; G01N 2021/1748; G01N 2021/1765; G01N 2021/177; G01N 21/25; G01N 21/31; G01N 21/314; G01N 2021/3148; B42D 25/29; B42D 25/355; B42D 25/36; B42D 2033/18; B42D 2035/34

See application file for complete search history.

(56) References Cited

U.S. PATENT DOCUMENTS

| | | | | |
|---|---|---|---|---|
| 2003/0108074 | A1 | 6/2003 | Lawandy | 372/42 |
| 2003/0194052 | A1 | 10/2003 | Price et al. | 378/45 |
| 2003/0232179 | A1* | 12/2003 | Steenblik et al. | G07D 7/206 428/195.1 |
| 2004/0118930 | A1 | 6/2004 | Berardi et al. | 235/492 |
| 2005/0178841 | A1 | 8/2005 | Jones, II et al. | 235/468 |
| 2009/0141961 | A1 | 6/2009 | Smith et al. | 382/135 |
| 2012/0104278 | A1 | 5/2012 | Downing et al. | 250/458.1 |

OTHER PUBLICATIONS

Written Opinion of the International Searching Authority in PCT/US2018/064655 (dated Apr. 1, 2019).

International Search Report in PCT/US2018/064655 (dated Apr. 1, 2019).

* cited by examiner

*Primary Examiner* — Andrew W Johns

(74) *Attorney, Agent, or Firm* — Pryor Cashman LLP

(57) ABSTRACT

An authentication system and associated method including a substrate including one or more doped inclusions disposed in or on the substrate at one or more portions of the substrate such that electromagnetic radiation absorption and reflectance varies between a portion of the substrate in which a doped inclusion is disposed and a portion of the substrate in which no doped inclusion is disposed, and a detector including an electromagnetic radiation source configured to irradiate the substrate with electromagnetic radiation at multiple wavelengths and an imaging system configured to acquire multiple images of the substrate subjected to irradiation.

27 Claims, 3 Drawing Sheets

TAGGANT SYSTEM

CROSS-REFERENCE TO RELATED APPLICATIONS

The present application claims priority to U.S. provisional application Ser. No. 62/596,558, filed Dec. 8, 2017, the disclosure of which is incorporated herein by reference in its entirety.

TECHNICAL FIELD

The present invention relates to a taggant system. More particularly, the present invention relates to a taggant system that involves doped inclusions, which may be used in connection with paper currency.

BACKGROUND OF THE INVENTION

Counterfeiting is a growing business and economic concern. Various products and items are subject to counterfeiting. Currency is an example of such an item. Counterfeit currency is often difficult to detect. Currency manufacturers attempt to discourage and prevent counterfeiting through various techniques, such as the inclusion of security elements in the currency substrate material. Nevertheless, these techniques are often circumvented by counterfeiters. As counterfeiters have become more sophisticated, the security elements in currency have had to become more advanced as well in order to prevent widespread fraud. Accordingly, there is a need for an efficient high security mechanism to protect currency from counterfeiting.

SUMMARY OF THE INVENTION

In general, in one aspect, the invention features an authentication system including a substrate including one or more doped inclusions disposed in or on the substrate at one or more portions of the substrate such that electromagnetic radiation absorption and reflectance varies between a portion of the substrate in which a doped inclusion is disposed and a portion of the substrate in which no doped inclusion is disposed, and a detector including an electromagnetic radiation source configured to irradiate the substrate with electromagnetic radiation at multiple wavelengths and an imaging system configured to acquire multiple images of the substrate subjected to irradiation.

Implementations of the invention may include one or more of the following features. The substrate may be paper currency. The one or more doped inclusions may include disk-shaped inclusions, planchette-based inclusions, fiber-based inclusions, or a combination thereof. The one or more doped inclusions may be doped with one or more dopants that are inorganic, have a nanoscale size distribution, have a melting temperature of less than 1,000° C., or a combination thereof. The one or more doped inclusions may be doped with one or more sharp linewidth absorber dopants. The one or more doped inclusions may include a first doped inclusion and a second doped inclusion, where the first doped inclusion differs from the second doped inclusion on the basis of a utilized dopant, a physical parameter, or both. The first doped inclusion may differ from the second doped inclusion at least on the basis of a physical parameter, where the physical parameter is a length, radius, diameter, or size of the doped inclusion. At least one doped inclusion of the one or more doped inclusions may provide a single absorption line or multiple absorption lines. The one or more doped inclusions may be invisible to the naked eye when disposed in the substrate. The electromagnetic radiation source may be configured to emit electromagnetic radiation at a first wavelength corresponding or substantially corresponding to an absorption peak of the doped inclusion and at least one of a second wavelength and a third wavelength, where the second wavelength is less than the first wavelength and corresponds to a first side of the absorption peak, and where the third wavelength is greater than the first wavelength and corresponds to a second side of the absorption peak opposite to the first side of the absorption peak In general, in another aspect, the invention features a method of authentication including irradiating, with an electromagnetic radiation source of a detector, at multiple wavelengths a substrate including one or more doped inclusions disposed in or on the substrate at one or more portions of the substrate such that electromagnetic radiation absorption and reflectance varies between a portion of the substrate in which a doped inclusion is disposed and a portion of the substrate in which no doped inclusion is disposed; acquiring, with an imaging system of the detector, multiple images of the substrate subjected to irradiation at the multiple wavelengths; and detecting the one or more doped inclusions through an image analysis of the multiple images.

Implementations of the invention may include one or more of the following features. The image analysis may be a pixel-based subtraction process of subtracting a first image of the multiple images in which the substrate was subjected to irradiation at a first wavelength from a second image of the multiple images in which the substrate was subjected to irradiation at a second wavelength. The image analysis may include a step of subtracting the first image from the second image and the first image from a third image of the multiple images in which the substrate was subjected to irradiation at a third wavelength. The substrate may be paper currency. The one or more doped inclusions may include disk-shaped inclusions, planchette-based inclusions, fiber-based inclusions, or a combination thereof. The one or more doped inclusions may be doped with one or more dopants that are inorganic, have a nanoscale size distribution, have a melting temperature of less than 1,000° C., or a combination thereof. The one or more doped inclusions may be doped with one or more sharp linewidth absorber dopants. The one or more doped inclusions may include a first doped inclusion and a second doped inclusion, where the first doped inclusion differs from the second doped inclusion on the basis of a utilized dopant, a physical parameter, or both. The first doped inclusion may differ from the second doped inclusion at least on the basis of a physical parameter, where the physical parameter is a length, radius, diameter, or size of the doped inclusion. Doped inclusions having different absorption characteristics or physical parameters may be interspersed in the substrate to build an authentication code. At least one doped inclusion of the one or more doped inclusions may provide a single absorption line or multiple absorption lines.

The detector may include a white light source and multiple cameras, where each camera of the multiple cameras uses a different bandpass filter to create images at a first wavelength and at least one of a second wavelength and a third wavelength sequentially or simultaneously. The detector may include multiple narrow bandwidth light sources and a single camera, where each light source of the multiple narrow bandwidth light sources has a single emission at one of a first wavelength, a second wavelength, and a third wavelength, and where images are acquired at a first wavelength and at least one of a second wavelength and a third wavelength with the single camera by sequential operation of the multiple narrow bandwidth light sources. The detector may include a white light source and a single camera, where the single camera uses sequentially interchangeable band-pass filters to create images at a first wavelength and at least one of a second wavelength and a third wavelength. The detector may include multiple narrow bandwidth light sources and a corresponding number of cameras, where each camera of the corresponding number of cameras includes an interposed filter to pass only a wavelength of a corresponding light source of the multiple narrow bandwidth light sources, and where images at all wavelengths are simultaneously acquired. The image analysis may include a step of measuring one or more physical parameters of the one or more doped inclusions, where the physical parameter is a length, radius, diameter, size, or shape, and where the substrate is determined to be authentic when each measured physical parameter of the one or more physical parameters is within a predetermined range. The method may further include a calibration step, where the calibration step ensures each pixel of a first image corresponds to a same position on the substrate as each corresponding pixel from a second image.

DETAILED DESCRIPTION OF THE INVENTION

The taggant system of the present invention may be utilized in a substrate such as paper, which may be paper currency. In a preferred embodiment, the taggant system is dispersed throughout the utilized substrate.

The taggant system may be functional at one or more of several frequencies in the electromagnetic spectrum, including ultraviolet (UV), visible, and infrared dull or inactive. In a preferred embodiment, the taggant system is invisible to the naked eye in paper with no body color.

The taggant system of the present invention includes two components, namely an inclusion disposed in or embedded in the substrate, and a dopant disposed in or on or incorporated into the inclusion. The inclusion may be any material of one or more engineered sizes and/or shapes that are compatible with substrate manufacturing processes. In one embodiment, the inclusion is a disk-shaped inclusion. In another embodiment, the inclusion is a planchette-based inclusion. In another embodiment, the inclusion is a fiber-based inclusion. The inclusion may include polymer-like fibers, coated paper, glass, and the like, which are incorporated into or embedded in the substrate.

The inclusion is doped with a dopant capable of permitting the taggant system to have a varied absorption/reflectance from the absorption/reflectance of substrate areas that do not contain the taggant system. In particular, the dopant is capable of absorbing incident radiation at a predetermined wavelength or wavelengths. The selected dopant may be inorganic, have nanoscale size distribution, and/or have a melting temperature of less than 1,000° C. In one embodiment, the dopant is any sharp linewidth absorber, such as a plasmon ice nanoparticle.

In an embodiment in which the inclusion is a fiber-based inclusion, the taggant system may include polymer fiber hosts with dopants incorporated into the fibers, in which the fibers are incorporated into or embedded in the substrate.

Through usage of the described doped inclusions in a substrate, electromagnetic radiation absorption and reflection varies at those locations in the substrate in which the doped inclusions are positioned. In other words, there is a dip in absorption in the reflected radiation spectrum at these doped inclusion positions. Specific single or multiple absorption lines may be presented as a result of dopant selection and/or inclusion of different sets of inclusions doped with varying dopants. In a preferred embodiment, multiple absorption lines result from a single dopant fiber. Multiple absorption lines may also be produced via inclusion of glasses, crystals, dyes, and the like, as a result of vibrational mode and/or electronic state features.

Figure 1:
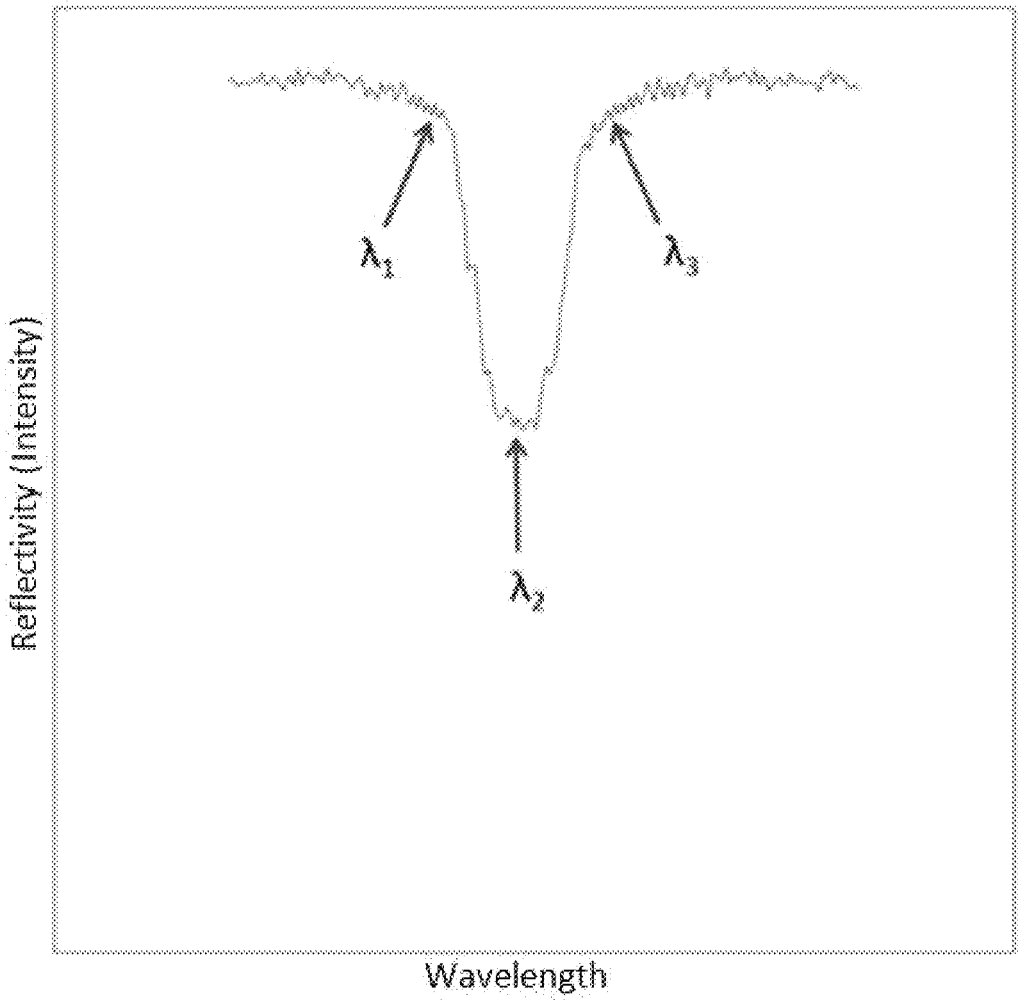
FIG. 1 shows a model reflective intensity spectrum with an absorption line corresponding to a wavelength of radiation absorbed by a taggant system according to an embodiment of the present invention.

FIG. 1 shows a model reflective intensity spectrum with an absorption line corresponding to a certain wavelength of radiation ($\lambda_2$) absorbed by a taggant system, e.g., a doped inclusion. If examination is performed at other wavelengths, such as $\lambda_1$ and $\lambda_3$, the reflectivity of the examined substrate does not present any irregularity, e.g., absorption dip in the reflected radiation spectrum. However, examination at the wavelength $\lambda_2$ presents an irregularity indicative of the presence of the relevant doped inclusion. By measuring the reflectance of electromagnetic radiation from the substrate containing the taggant system of the present invention, changes or irregularities in reflectivity/absorption may be observed, and the presence and/or location of the taggant system may be determined.

With respect to the counterfeit resistance properties of the taggant system of the present invention, the system may include several levels of security. A first level of security may be such that materials of the taggant system cannot be seen by the naked eye, e.g., in paper. Doped inclusions may be colorless and/or functional at one or more of several frequencies in the electromagnetic spectrum, including ultraviolet (UV), visible, and infrared dull or inactive. Additionally, the taggant system may be distributed and detected throughout an entire item, e.g., a currency note. This may be useful in detecting composite counterfeits.

A second level of security may be such that the dopants are or include substances not recorded in chemical and crystallographic databases. The taggant system may be detected via Spectrally Resolved Image Processing (SRIP), have a resolution of approximately 1 nm, and/or include covert wavelength positions and linewidths.

Figure 2:
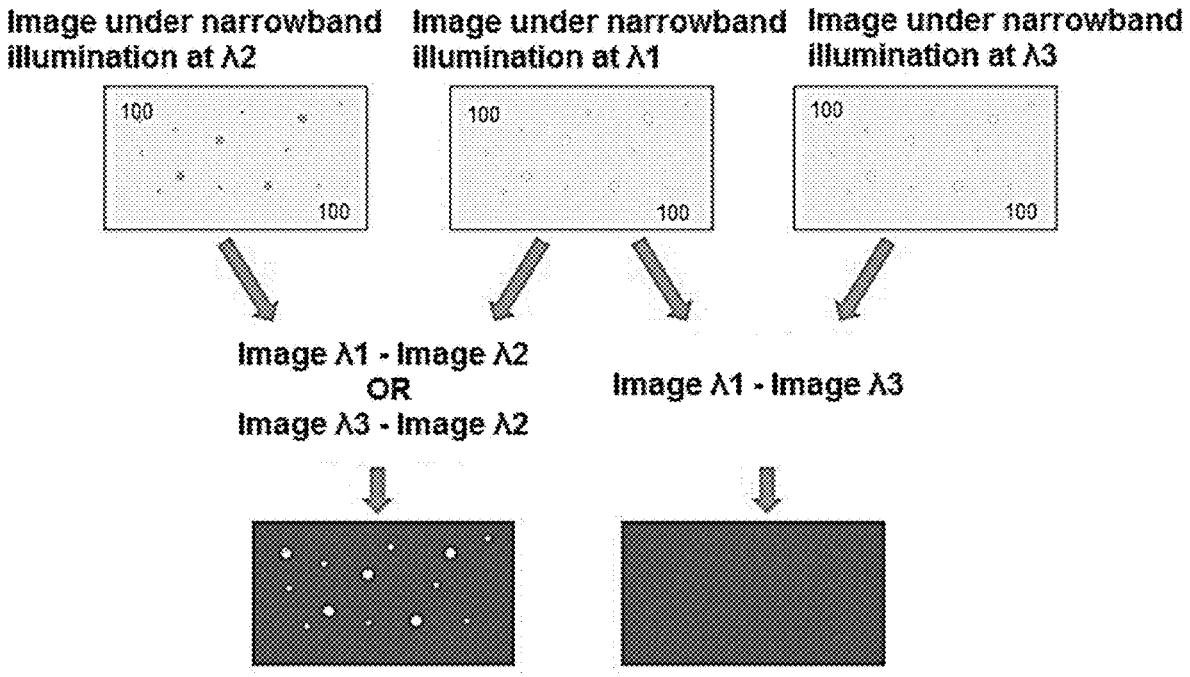
FIG. 2 shows several wavelength analysis images of a currency note incorporating a taggant system including disk-shaped inclusions according to an embodiment of the present invention.
Figure 3:
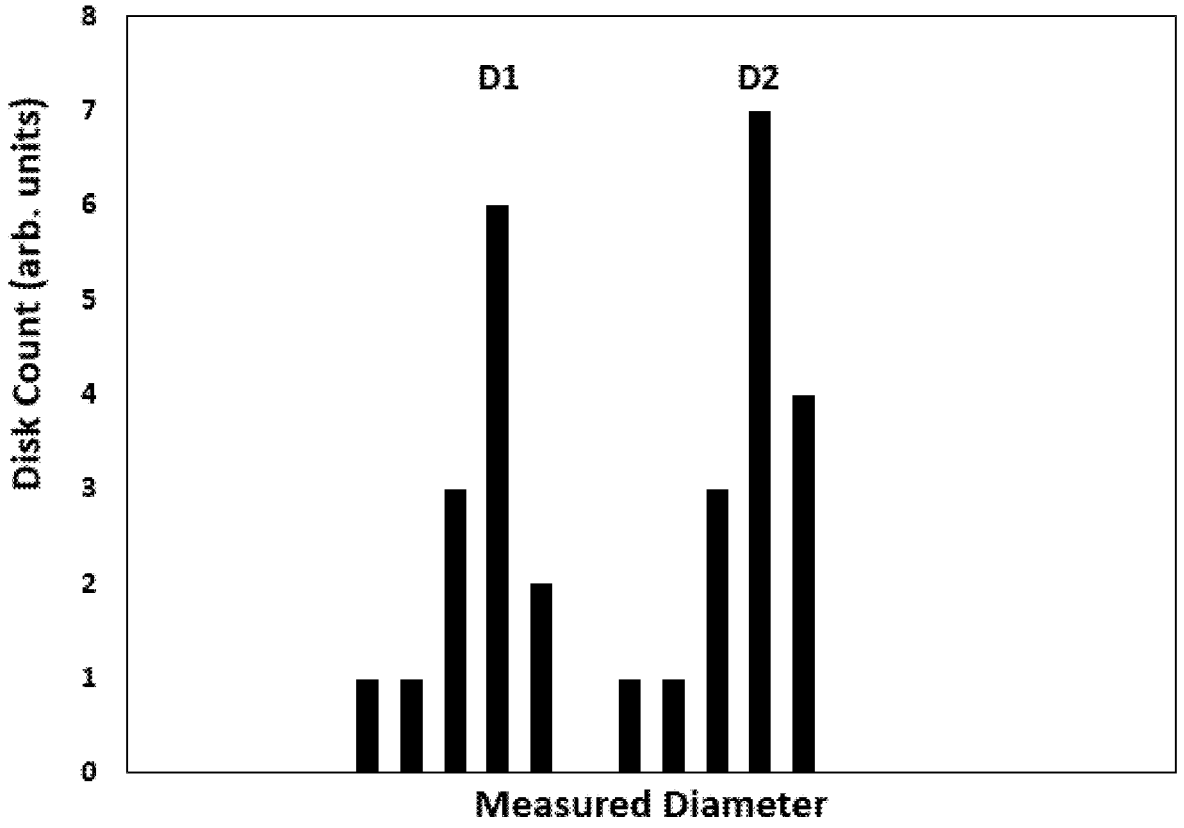
FIG. 3 shows an inclusion diameter analysis of the taggant system of FIG. 2.

A third level of security may be such that the taggant system is capable of multiple unique code configurations, including over fifteen distinct codes. The coding configurations may be used to identify and/or verify the denominations of the currency. These codes may be single or binary codes. The codes may be created based on combinations of dopant selection and physical size and/or shape parameters of the inclusion (e.g., length, radius/diameter, and the like). Doped inclusions having different absorption characteristics and/or physical parameters may be predictably interspersed in the substrate to build an authentication code. Dopants may include a first dopant (dopant A), a second dopant (dopant B), or a combination of both. Inclusion parameters may be a first diameter (D1), a second diameter (D2), or a combination of both. For fiber-based inclusions, the inclusion parameter may be a first length (L1), a second length (L2), or a combination of both. FIG. 2 shows inclusions of multiple diameters in a taggant system utilizing disk-shaped inclusions, and FIG. 3 shows an inclusion diameter analysis of said taggant system. For example, based on the aforementioned nomenclature for dopant selection and inclusion parameter, the following different codes are possible: AD1, AD2, BD1, BD2, AD1/BD2, AD2/BD1, BD1/BD2, AD1/BD1, AD2/BD2, and AD1/AD2.

The present invention is not limited to utilization of two differently-sized inclusions and/or two different dopants, but can include further sizes, shapes, and dopants to create more complex codes. In such an example, the taggant system may utilize a combination of different shapes (e.g., both disks and fibers) to create these complex codes. Codes may also be created based on the absence of doped inclusions having certain aforementioned aspects. The described techniques may be further combined with each other to create additional codes.

FIG. 2 shows a paper currency incorporating disk-shaped inclusions according to one embodiment of the present invention, analyzed using several wavelengths. As illustrated, the design print is shown as covering certain portions of the disk-shaped inclusions, such as at the location of the top-left "100" marking, which has been printed with an ink that absorbs at the wavelengths of interest, namely $\lambda_1$, $\lambda_2$, and $\lambda_3$. One example of such an ink is intaglio ink. The currency note is subjected to illumination at several different wavelengths, namely $\lambda_1$, $\lambda_2$, and $\lambda_3$. The inclusions are visible when the note is illuminated with a light source emitting narrow bandwidth light at wavelength $\lambda_2$, due to the light at said wavelength being absorbed by the taggant system at inclusion locations to a greater degree than light reflecting from areas of the note around the inclusions. As illustrated, when the currency note is illuminated with a light source emitting narrow bandwidth light at wavelength $\lambda_1$ or $\lambda_3$, the inclusions will not appear to be visible from the rest of the note because the taggant system has no absorption at these wavelengths.

Moreover, in an embodiment in which the inclusion material has similar reflectivity characteristics as the currency note substrate, the inclusions will be essentially invisible. It is preferable that the absorption linewidth of the taggant system be very narrow with respect to the visible spectrum. By utilizing a narrow linewidth for the taggant system, the ability of a counterfeiter to both detect the presence of the taggant system under normal white light illumination conditions and counterfeit the taggant system is more difficult.

In a preferred embodiment of the present invention, a detector suitable for locating and authenticating the taggant system is constructed from an imaging system, including a camera and lens, and an illumination light source. In the example of FIG. 2, the absorption dip at wavelength $\lambda_2$ can be observed through use, e.g., of narrow bandpass filters at wavelengths $\lambda_1$, $\lambda_2$, and/or $\lambda_3$ in front of the camera with a white light illumination source, or multiple light sources at wavelengths $\lambda_1$, $\lambda_2$, and/or $\lambda_3$. By capturing at least two images of the currency note under illumination at wavelength $\lambda_2$ and wavelength $\lambda_1$ or $\lambda_3$ respectively and performing a pixel-based subtraction process, the image acquired under illumination at wavelength $\lambda_2$ is subtracted from the image acquired under illumination at wavelength $\lambda_1$ or $\lambda_3$, resulting in the image shown at the bottom left-hand side of FIG. 2. The image acquired under illumination at wavelength $\lambda_2$ may be subtracted from both images acquired under illumination at wavelength $\lambda_1$ and $\lambda_3$. Additionally, a calibration step may be performed during this process, such as prior to image acquisition, in which calibration ensures each pixel of one image corresponds to a same position on the substrate as each corresponding pixel from another image. Additionally, an image analysis process of the present invention may include measurement of physical parameter(s) of the doped inclusions, such as on the basis of length, radius, diameter, size, and/or shape, in which a substrate is authenticated when the physical parameter(s) is measured and determined to be within a set range.

At areas of the currency note outside of the inclusion locations, the two input images are identical such that the subtraction process results in dark areas (i.e., pixel intensity values of 0). At the inclusion locations, pixel values at wavelength $\lambda_2$ are lower than corresponding pixel values at wavelength $\lambda_1$ or $\lambda_3$, such that subtraction process results in pixel values larger than 0. The image produced by this subtraction process indicates only the relevant inclusions, eliminating other features of the note (e.g., ink, threads, etc.) that are common in each of the input images (e.g., at wavelength $\lambda_2$ and wavelength $\lambda_1$ or $\lambda_3$). Image processing algorithms may then be utilized to further authenticate the taggant system, such as according to physical size and/or shape parameters of the inclusion or location of the inclusion within the currency note substrate. Finally, when the image acquired under illumination at wavelength $\lambda_1$ is subtracted from the image acquired under illumination at wavelength $\lambda_3$, or vice versa, the resulting image provides no indications of the relevant inclusions, as shown in the bottom right-hand image of FIG. 2.

A light source of the present invention may emit electromagnetic radiation at wavelength $\lambda_2$, which corresponds or substantially corresponds to an absorption peak of a doped inclusion, and at least one of wavelengths $\lambda_1$ and $\lambda_3$, where $\lambda_1<\lambda_2<\lambda_3$. Additionally, a detector of the present invention may include a white light source and multiple cameras, with each camera of the multiple cameras using a different bandpass filter to create images at wavelength $\lambda_2$ and at least one of wavelengths $\lambda_1$ and $\lambda_3$ sequentially or simultaneously. In another embodiment, a detector of the present invention may include multiple narrow bandwidth light sources and a single camera, with each light source having a single emission at one of wavelengths $\lambda_1$, $\lambda_2$, or $\lambda_3$, and where images are acquired at wavelength $\lambda_2$ and at least one of wavelengths $\lambda_1$ and $\lambda_3$ with the single camera by sequential operation of the multiple narrow bandwidth light sources. In another embodiment, a detector of the present invention may include a white light source and a single camera, with the camera using sequentially interchangeable bandpass filters to create images at wavelength $\lambda_2$ and at least one of wavelengths $\lambda_1$ and $\lambda_3$. In another embodiment, a detector of the present invention may include multiple narrow bandwidth light sources and a corresponding number of cameras, with each camera including an interposed filter to pass only a wavelength of the corresponding light source of the multiple narrow bandwidth light sources, and where images at all wavelengths are simultaneously acquired.

In another aspect of the present invention, the taggant system may be utilized above or under other features of the currency note, such as ink, threads, etc. When the taggant system sits below such a feature, e.g., ink, the inclusion is covered and consequently masked when subjected to the aforementioned subtraction process, as light contacts, i.e., reflects off of or is absorbed by, the ink and not the inclusion. This masking effect is illustrated in FIG. 2 where the top-left "100" marking covers an inclusion, resulting in a masked portion of the disk-shaped inclusion in the subtraction image. Detecting whether the taggant system is disposed above or under other note features is another way to determine the authenticity of the currency note.

It will be understood by those of ordinary skill in the art that various changes may be made and equivalents may be substituted for elements without departing from the scope of the invention. In addition, many modifications may be made to adapt a particular feature or material to the teachings of the invention without departing from the scope thereof. Therefore, it is intended that the invention not be limited to the particular embodiments disclosed, but that the invention will include all embodiments falling within the scope of the claims.

What is claimed is:

1. An authentication system, comprising:

a substrate including one or more doped inclusions disposed in or on the substrate at one or more portions of the substrate such that electromagnetic radiation absorption and reflectance varies between a portion of the substrate in which a doped inclusion is disposed and a portion of the substrate in which no doped inclusion is disposed, wherein the one or more doped inclusions comprise one or more sharp linewidth absorber dopants; and a detector including:

an electromagnetic radiation source configured to irradiate the substrate with electromagnetic radiation at multiple wavelengths, and an imaging system configured to acquire multiple images of the substrate subjected to irradiation.

2. The system of claim 1, wherein the substrate is paper currency.

3. The system of claim 1, wherein the one or more doped inclusions comprise disk-shaped inclusions, planchette-based inclusions, fiber-based inclusions, or a combination thereof.

4. The system of claim 1, wherein the one or more doped inclusions are doped with one or more dopants that are inorganic, have a nanoscale size distribution, have a melting temperature of less than 1,000° C., or a combination thereof.

5. The system of claim 1, wherein the one or more doped inclusions comprise a first doped inclusion and a second doped inclusion, and wherein the first doped inclusion differs from the second doped inclusion on the basis of a utilized dopant, a physical parameter, or both.

6. The system of claim 5, wherein the first doped inclusion differs from the second doped inclusion at least on the basis of a physical parameter, and wherein the physical parameter is a length, radius, diameter, or size of the doped inclusion.

7. The system of claim 1, wherein at least one doped inclusion of the one or more doped inclusions provides a single absorption line.

8. The system of claim 1, wherein at least one doped inclusion of the one or more doped inclusions provides multiple absorption lines.

9. The system of claim 1, wherein the one or more doped inclusions are invisible to the naked eye when disposed in the substrate.

10. The system of claim 1, wherein the electromagnetic radiation source is configured to emit electromagnetic radiation at a first wavelength corresponding or substantially corresponding to an absorption peak of the doped inclusion and at least one of a second wavelength and a third wavelength, wherein the second wavelength is less than the first wavelength and corresponds to a first side of the absorption peak, and wherein the third wavelength is greater than the first wavelength and corresponds to a second side of the absorption peak opposite to the first side of the absorption peak.

11. A method of authentication, comprising:

irradiating, with an electromagnetic radiation source of a detector, at multiple wavelengths a substrate including one or more doped inclusions disposed in or on the substrate at one or more portions of the substrate such that electromagnetic radiation absorption and reflectance varies between a portion of the substrate in which a doped inclusion is disposed and a portion of the substrate in which no doped inclusion is disposed, wherein the one or more doped inclusions comprise one or more sharp linewidth absorber dopants;

acquiring, with an imaging system of the detector, multiple images of the substrate subjected to irradiation at the multiple wavelengths; and detecting the one or more doped inclusions through an image analysis of the multiple images.

12. The method of claim 11, wherein the image analysis is a pixel-based subtraction process of subtracting a first image of the multiple images in which the substrate was subjected to irradiation at a first wavelength from a second image of the multiple images in which the substrate was subjected to irradiation at a second wavelength.

13. The method of claim 12, wherein the image analysis includes a step of subtracting the first image from the second image and the first image from a third image of the multiple images in which the substrate was subjected to irradiation at a third wavelength.

14. The method of claim 11, wherein the substrate is paper currency.

15. The method of claim 11, wherein the one or more doped inclusions comprise disk-shaped inclusions, planchette-based inclusions, fiber-based inclusions, or a combination thereof.

16. The method of claim 11, wherein the one or more doped inclusions are doped with one or more dopants that are inorganic, have a nanoscale size distribution, have a melting temperature of less than 1,000° C., or a combination thereof.

17. The method of claim 11, wherein the one or more doped inclusions comprise a first doped inclusion and a second doped inclusion, and wherein the first doped inclusion differs from the second doped inclusion on the basis of a utilized dopant, a physical parameter, or both.

18. The method of claim 17, wherein the first doped inclusion differs from the second doped inclusion at least on the basis of a physical parameter, and wherein the physical parameter is a length, radius, diameter, or size of the doped inclusion.

19. The method of claim 11, wherein doped inclusions having different absorption characteristics or physical parameters are interspersed in the substrate to build an authentication code.

20. The method of claim 11, wherein at least one doped inclusion of the one or more doped inclusions provides a single absorption line.

21. The method of claim 11, wherein at least one doped inclusion of the one or more doped inclusions provides multiple absorption lines.

22. The method of claim 11, wherein the detector comprises a white light source and multiple cameras, and wherein each camera of the multiple cameras uses a different bandpass filter to create images at a first wavelength and at least one of a second wavelength and a third wavelength sequentially or simultaneously.

23. The method of claim 11, wherein the detector comprises multiple narrow bandwidth light sources and a single camera, and wherein each light source of the multiple narrow bandwidth light sources has a single emission at one of a first wavelength, a second wavelength, and a third wavelength, and wherein images are acquired at a first wavelength and at least one of a second wavelength and a third wavelength with the single camera by sequential operation of the multiple narrow bandwidth light sources.

24. The method of claim 11, wherein the detector comprises a white light source and a single camera, and wherein the single camera uses sequentially interchangeable bandpass filters to create images at a first wavelength and at least one of a second wavelength and a third wavelength.

25. The method of claim 11, wherein the detector comprises multiple narrow bandwidth light sources and a corresponding number of cameras, wherein each camera of the corresponding number of cameras includes an interposed filter to pass only a wavelength of a corresponding light source of the multiple narrow bandwidth light sources, and wherein images at all wavelengths are simultaneously acquired.

26. The method of claim 11, wherein the image analysis includes a step of measuring one or more physical parameters of the one or more doped inclusions, wherein the physical parameter is a length, radius, diameter, size, or shape, and wherein the substrate is determined to be authentic when each measured physical parameter of the one or more physical parameters is within a predetermined range.

27. The method of claim 11, further comprising a calibration step, wherein the calibration step ensures each pixel of a first image corresponds to a same position on the substrate as each corresponding pixel from a second image.

* * * * *